US006916758B2

(12) United States Patent
Reneker et al.

(10) Patent No.: US 6,916,758 B2
(45) Date of Patent: Jul. 12, 2005

(54) FIBROUS CATALYST-IMMOBILIZATION SYSTEMS

(75) Inventors: Darrell Reneker, Akron, OH (US); George Chase, Wadsworth, OH (US); Daniel Smith, Stow, OH (US)

(73) Assignee: The University of Akron, Akron, OH (US)

( * ) Notice: Subject to any disclaimer, the term of this patent is extended or adjusted under 35 U.S.C. 154(b) by 0 days.

(21) Appl. No.: 10/445,542

(22) Filed: May 27, 2003

(65) Prior Publication Data

US 2003/0232195 A1 Dec. 18, 2003

Related U.S. Application Data

(60) Provisional application No. 60/389,573, filed on Jun. 18, 2002.

(51) Int. Cl.[7] ..... C08F 4/02

(52) U.S. Cl. ..... 502/87; 502/103; 502/100; 502/439; 502/102

(58) Field of Search ..... 502/103, 100, 502/102, 87, 439

(56) References Cited

U.S. PATENT DOCUMENTS

| | | | | | |
|---|---|---|---|---|---|
| 3,870,530 | A | | 3/1975 | Roberts | 106/50 |
| 3,907,532 | A | * | 9/1975 | Roberts | 65/376 |
| 4,250,131 | A | * | 2/1981 | Sobel et al. | 264/622 |
| 5,500,200 | A | | 3/1996 | Mandeville et al. | 423/447.3 |
| 5,541,147 | A | * | 7/1996 | Friedlander et al. | 502/100 |
| 5,569,635 | A | * | 10/1996 | Moy et al. | 502/185 |
| 5,589,152 | A | | 12/1996 | Tennent et al. | 423/447.3 |
| 6,099,960 | A | | 8/2000 | Tennent et al. | 428/367 |
| 6,099,965 | A | | 8/2000 | Tennent et al. | 428/408 |
| 6,274,164 | B1 | | 8/2001 | Novich | 424/443 |
| 2001/0002626 | A1 | | 6/2001 | TenEyck | 422/176 |
| 2001/0014307 | A1 | * | 8/2001 | Moy et al. | 423/447.2 |

* cited by examiner

*Primary Examiner*—Ling-Sui Choi
(74) *Attorney, Agent, or Firm*—Roetzel & Andress; George W. Moxon, II

(57) ABSTRACT

The present invention provides a fibrous catalyst-immobilization system that can be employed for immobilizing catalysts that are subject to fluid flow within a chemical production process. The fibrous systems can be synthesized using electrospinning and the catalysts are secured in the fibers during the electrospinning process.

11 Claims, 2 Drawing Sheets

FIBROUS CATALYST-IMMOBILIZATION SYSTEMS

TECHNICAL FIELD

This invention relates to fibrous catalyst-immobilization systems and methods for their synthesis and use.

BACKGROUND OF THE INVENTION

Chemical production processes generally employ fluid flow as a means for introducing chemical reactants to relatively fixed catalyst pellets. But these catalyst pellets fracture into particles, which deleteriously impacts processing efficiency.

Not only can these particles damage processing equipment and interfere with reaction products, but ordinary environmental regulations require that they be filtered out of a processing fluid prior to discharge into the environment. Moreover, fractured catalyst pellets must be replaced. Therefore, a method for preventing catalyst pellets from fracturing would significantly improve the efficiency of chemical production processes.

Another problem relates to the transport rates of reactants and reaction products to and from a catalyst pellet's catalytic reaction cites. Generally, chemical reactants reach a catalyst pellet's inner-surface area by traveling through the pellets' pores. However, as the size of a pellet increases, the length of its pores increases proportionally. And relatively large catalyst pellets can have pore lengths so great that all of their catalytic reaction sites are not utilized by the reactants. This problem stems from the prior art's methods that employ porous catalyst pellets having characteristic dimensions ranging from a few microns to a few millimeters.

SUMMARY OF THE INVENTION

The present invention provides a fibrous catalyst-immobilization system composition comprising a fiber and a catalyst encapsulated within the fiber.

The present invention also provides a method for securing the relative positions of catalysts that are subject to fluid flow comprising the steps of providing a fibrous catalyst-immobilization system, securing the system to a structure that is not displaced as a result of the fluid flow, and subjecting the system to the fluid flow.

The present invention also provides a method for preparing fibrous catalyst-immobilization systems comprising the steps of providing a solution comprising both a fiber-forming material and a catalyst, and processing the solution into at least one fiber.

Fibrous catalyst-immobilization systems (fibrous systems) advantageously overcome problems in the prior art by protecting a catalyst pellet from fracture while securing its relative position within a production process employing fluid flow. Transport limitations are also overcome because the fibrous systems can employ relatively smaller catalysts than those catalysts employed in the prior art. Fibrous systems provide an additional advantage in that the thickness of the fiber surrounding a catalyst is relatively thin, which allows reactants to diffuse in and out of the fibrous systems in a relatively short times.

The term "pellet" refers to a solid substance, e.g., porous substance or monolith, that can be granular, sheet-like, or needle-like that also has a characteristic dimension as small as about two nanometers.

The term "characteristic dimension" refers to a measurable length that is a primary means for describing a catalytic substance. For instance, where a solid catalytic substance is granular, a characteristic dimension is its diameter; where a solid catalytic substance is rod-like, its characteristic dimensions are diameter and length; where a solid catalytic substance is sheet-like, its characteristic dimensions are its thickness, length, and width.

DETAILED DESCRIPTION OF THE INVENTION

Figure 1B:
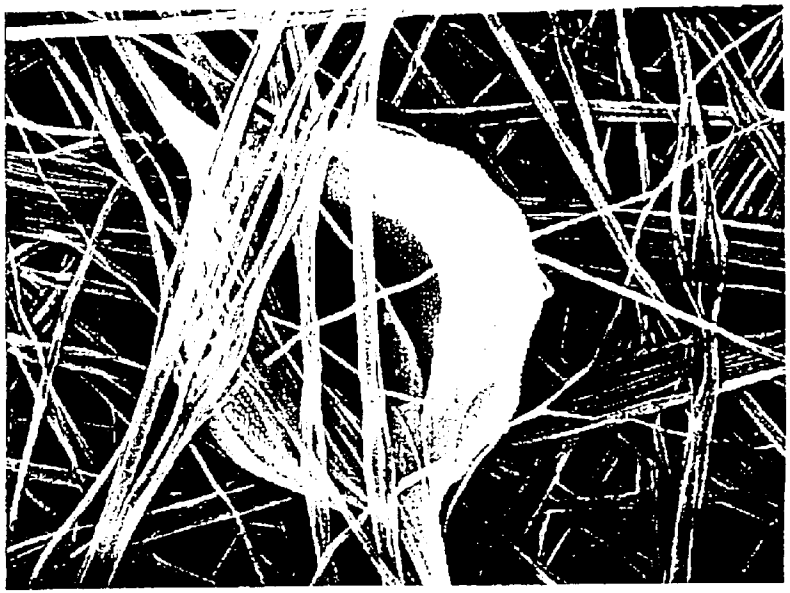
FIG. 1B is a scanning-electron-microscope image of the fibrous system as presented in FIG. 1A after PEOz was dissolved from the fibrous system with water. Removing the PEOz revealed portions of the surface of the pollen particle. In this figure, one inch is the scale equivalent of 10 microns.

Fibrous catalyst-immobilization systems comprise a fiber and at least one catalyst encapsulated within the fiber. The term "encapsulate" refers to the positioning of a catalyst within a fiber. A catalyst is encapsulated within a fiber when it is tethered within a fiber such that none or part of the catalyst's surface area is exposed. FIGS. 1A, 1B, 2A, and 2B provide illustrative examples of fibrous systems.

Catalysts are substances that either accelerate or retard the rates of chemical reactions without being permanently affected thereby. Catalysts can be inorganic, organic, or mixtures thereof; they can exist in any physical solid state and as single molecules. Solid catalysts are generally produced commercially as both porous substances and monoliths. Monolithic catalysts lack pores and therefore only their outer surface areas can present catalytic reaction sites to reactants. Porous substances, on the other hand, tend to maximize their surface area per unit mass and therefore have far greater surface area per unit of mass than monoliths. Molecular catalysts can provide even greater surface areas per unit mass than porous solids.

Any catalyst can be employed in the fibrous systems, and persons having ordinary skill in the art can select useful catalysts without undue experimentation. Nonlimiting examples of catalysts that can be employed include zeolites, aluminum silicates, metals, and metal-containing compounds.

Catalysts can be employed in fibrous systems wherein the catalysts have characteristic dimensions ranging from the molecular level up to solids having characteristic dimensions of about 2 millimeters. Preferably a characteristic deminsion of a solid catalyst is at least about two nanometers. More preferably, catalysts having characteristic dimensions ranging from about 5 nanometers to about 1 millimeter are employed. Still more preferably, catalysts having characteristic dimensions ranging from about 100 nanometers to about 100 microns are employed.

The catalyst loading of a fibrous catalyst-immobilization system can make up from about 0.01% to about 99% weight of the fibrous system. Preferably catalytic loading makes up from about 0.1% to about 10% weight of the fibrous system, and more preferably catalytic loading makes up from about 1% to about 10% weight of the fibrous system.

Fibers employed in the present invention can comprise a variety of fiber-forming materials, which include any polymer that can be dissolved in a solvent. Preferably, a polymer that retains its mechanical strength while swollen within solvents, reactants, or reaction products is employed because of its durability under conventional chemical process operating conditions. More preferably, polymeric fiber-forming materials are employed in synthesizing fibers that can be crosslinked into a strong network after they are processed into a fiber. Examples of useful fiber-forming materials include, but are not limited to, polymers such as nylon, polyacrylonitrile (PAN), polyesters, polyurethanes, silanes, or copolymers thereof.

The percent concentration of fiber-forming material in a fibrous catalyst-immobilization system can make up from about 1% to about 99% weight of the system. Preferably fiber-forming material makes up from about 20% to about 80% weight of the system. More preferably, fiber-forming material makes up from about 40% to about 75% weight of the system.

Useful fibers have a diameter ranging from about 1 nanometer to about 25 microns. Preferably, the fibers have a diameter ranging from about 2 nanometers to about 2 microns. More preferably, the fibers have a diameter ranging from about 1 nanometer to about 1 micron, and still more preferably from about 1 nanometer to about 500 nanometers.

Figure 1A:
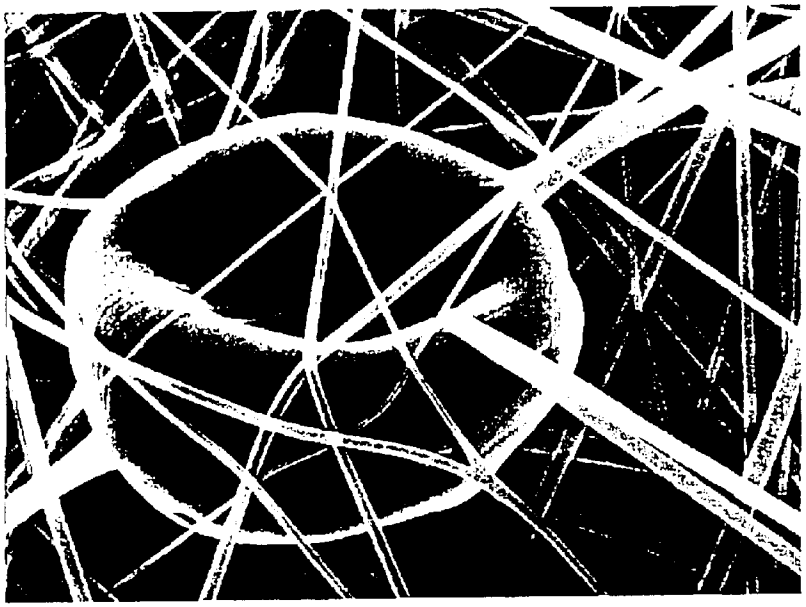
FIG. 1A is a scanning-electron-microscope image of a fibrous catalyst-immobilization system comprising the polymeric fiber-forming materials polycaprolactone and poly (ethyloxazoline) (PEOz) wherein a pollen particle is positioned within the fibrous system. In this figure, one inch is the scale equivalent of 10 microns.
Figure 2A:
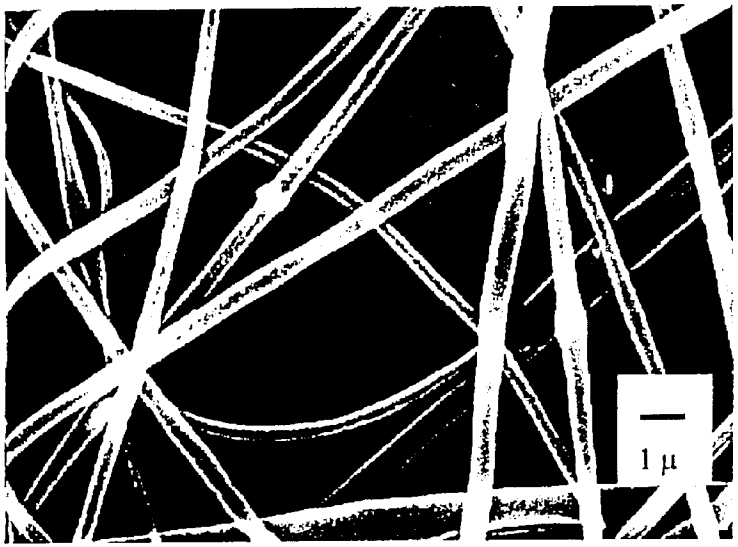
FIG. 2A is a scanning-electron-microscope image of a fibrous catalyst-immobilization system wherein a zinc oxide catalyst is positioned within a polycaprilactone fiber. In this figure, approximately 0.5 centimeters is the scale equivalent of 1 micron.
Figure 2B:
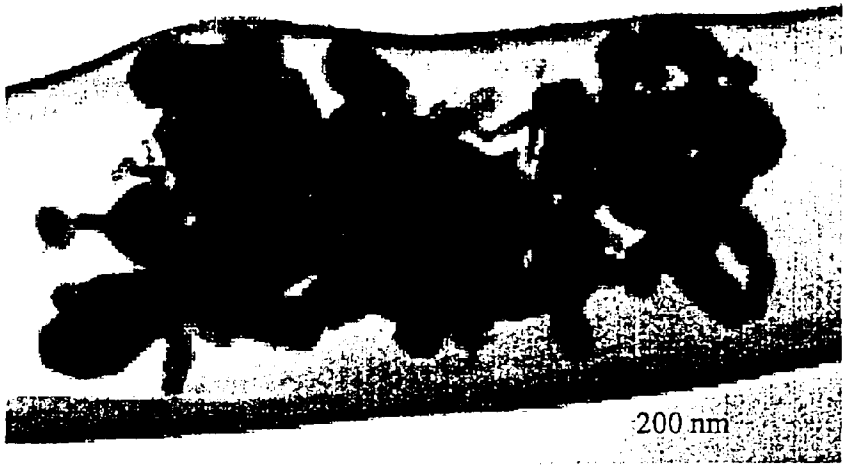
FIG. 2B is a transmission-electron-microscope image of a fibrous catalyst-immobilization system comprising a polycaprolactone fiber and a zinc oxide catalyst positioned therein. In this figure, approximately 1.5 cm is the scale equivalent of 200 nanometers.

The fibrous catalyst immobilization systems are made up, in part, of a fiber-forming material. In a preferred embodiment, two or more distinct polymers are employed as fiber-forming materials in fibrous catalyst-immobilization systems, and solubility differences preferably exist between the polymers employed. Solubility differences between the polymeric fiber-forming materials allow them to be selectively removed from a fibrous catalyst-immobilization system by dissolving them with a selected solvent. After using a selected solvent to dissolve one of the polymers, the remaining insoluble polymer(s) continue to encapsulate the catalysts while more of the catalytic surface area, which has been revealed by dissolving the soluble polymer, is exposed and therefore made available to reactants. FIGS. 1A and 1B are an illustration of a fibrous system comprising fiber-forming materials that have solubility differences. As a result, reactants and reaction products can diffuse more readily into and away from the catalyst. Further, the structure of the fibrous systems preferably allows processing fluids to flow through them at a relatively high rate. Preferably, poly(ethyloxazoline) (PEOz) and polycaprolactone are polymeric fiber-forming materials that are employed together in fibrous systems because of their solubility differences.

Where two distinct polymeric fiber-forming materials are employed in the fibrous system, the ratio of one polymer type to another can range from about 100:1 to about 1:1 by weight. Preferably the ratio ranges from about 75:1 to about 1:1 by weight, and more preferably the ratio ranges from about 50:1 to about 1:1 by weight.

Fibrous catalyst-immobilization systems can be employed in a variety of manners. They may be used by themselves to form a porous membrane, which can be constructed in cylindrical geometry. They can also be used in coordination with a support system such as a porous substrate or solid surface. Even further, they can be woven into a skeletal support matrix comprising other types of fibers.

When used by themselves, fibrous catalyst-immobilization systems can be woven together to form a porous membrane having many fibrous systems per unit area. In production processes, this membrane can be used with or without a support structure. While the membrane is being used in a production process, the fluid can flow either parallel or perpendicular to the membrane's surface. The reactants that are in the passing fluid can move through the membrane either by diffusion, osmotic pressure, or pressure drop. While moving through the membrane, the catalysts encapsulated within the fibers are exposed to the reactants and reaction products result.

A porous structure can be used to support layers of the fibrous systems within a chemical production process. The porous support structure is preferably designed with a low concentration of fibrous systems arranged in layers that are stacked and positioned perpendicular to the direction of fluid flow; each of these layers preferably having relatively few fibrous systems per unit area. The layers of fibrous systems preferably have spacing between them that gives depth to the stacked layers. And because each of the layers preferably has a low concentration of fibrous systems per unit area, enough of the layers are preferably stacked on top of each other to provide all of the passing reactants with a sufficient number of catalytic reaction sites. As the spacing between each of the stacked layers increases, the pressure required for the fluid to flow through the layers decreases. The pressure required for fluid to flow through a porous support structure with many stacked layers is less than the pressure required for the fluid to flow through a single membrane having a relatively dense concentration of fibers.

Various conventional techniques that can be used to form fibers can be employed in synthesizing fibrous catalyst-immobilization systems, however electrospinning is preferred. The technique of electrospinning of solutions containing fiber-forming material is known and has been described in a number of patents and general literature. Electrospinning involves introducing a solution into an electric field, whereby the solution is caused to produce fibers that tend to be drawn to an electrode. While being drawn from the solution, the fibers usually harden, which may involve cooling (e.g. where the liquid is normally solid at room temperature), chemical hardening (e.g. by treatment with a hardening vapor), or evaporation of solvent (e.g. by dehydration). The product fibers may be collected on a suitably located receiver and subsequently stripped from it. Electrospinning can produce fibers from a great variety of fiber-forming materials, and the fibers can have diameters greater than or equal to about two nanometers.

When electrospinning is employed, any solvent in which a fiber-forming material is soluble can be used to prepare solutions that can be used to synthesize fibrous systems. Therefore, when preparing solutions comprising fiber-forming materials and catalyst pellets, persons of ordinary skill in the art can select appropriate solvents based on the solubility characteristics of the fiber-forming material(s) without undue experimentation.

In preparing a solution to be used in forming fibrous systems, acetone is preferably employed as a common solvent where the solution comprises both PEOz and polycaprolactone as the fiber-forming material; water is preferrably employed as the solvent for selectively dissolving PEOz from the fiber.

Catalysts are preferably encapsulated within a fiber by adding them to a solution that is to be electrospun into a fiber. Upon electrospinning, the catalysts become encapsulated within the fiber.

Where a catalyst is soluble in a solution comprising fiber-forming material and electrospinning is employed in preparing a fibrous catalyst-immobilization system, fibrous systems typically result that comprise molecular catalysts. This occurs because the electrospinning process removes the solvent instantly and therefore prevents any soluble catalytic substance from crystalizing into a solid.

When synthesizing fibrous catalyst-immobilization systems using electrospinning techniques, soluble catalysts can be employed in a solution to be electrospun from about 0 to about 50 percent volume of the solution. Preferably soluble catalysts are employed from about 0 to about 30 percent volume of the solution. More preferably, soluble catalysts are employed from about 0 to about 15 percent volume of the solution.

When synthesizing fibrous catalyst-immobilization systems using electrospinning techniques, catalyst pellets can be employed in a solution to be electrospun from about 0 to about 25 percent volume of the solution. Preferably catalyst pellets are employed from about 0 to about 20 percent volume of the solution. More preferably, pellets are employed from about 0 to about 15 percent volume of the solution.

Where electrospinning is employed in synthesizing a fibrous system, the percent concentration of fiber-forming material in a solution for electrospinning can be from about 0 to about 25 percent volume of the solution. Preferably fiber-forming material is employed from about 0 to about 20 percent volume of the solution. More preferably, fiber-forming material is employed from about 0 to about 15 percent volume of the solution.

The percent concentration of a solvent in a solution for electrospinning can be from about 0 to about 99 percent volume of the solution. Preferably solvent is employed from about 0 to about 85 percent volume of the solution. More preferably, solvent is employed from about 0 to about 75 percent volume of the solution.

In order to demonstrate the practice of the present invention, the following examples have been prepared and tested. The examples should not, however, be viewed as limiting the scope of the invention. The claims will serve to define the invention.

EXAMPLES

Table I presents the composition and % volume of a solution that was electrospun into a fibrous catalyst-immobilization system.

TABLE I

| Component | % Volume of the Solution |
|---|---|
| Solvent = formic acid | 80–85 |
| Fiber-forming material = nylon | 15–20 |
| Catalyst = aluminum fibers | 1–2 |

The aluminum fibers are about two nanometers in diameter and 1 to 2 microns long. The aluminum fibers were made in a separate process and were added to the solution without modification.

While the best mode and preferred embodiment of the invention have been set forth in accord with the Patent Statues, the scope of this invention is not limited thereto, but rather is defined by the attached claims. Thus, the scope of the invention includes all modifications and variations that may fall within the scope of the claims.

What is claimed is:

1. A fibrous catalyst-immobilization system composition comprising:

a fiber; and a catalyst encapsulated within said fiber, wherein said fiber comprises a polymeric fiber-forming material.

2. The composition according to claim 1, wherein said fiber has a diameter ranging from about 2 nanometers to about 2 microns.

3. The composition according to claim 1, wherein said fiber comprises at least two distinct polymeric fiber-forming materials.

4. The composition according to claim 3, wherein at least one of said materials is soluble in a specific solvent while at least one of the other said materials is insoluble in said specific solvent.

5. The composition according to claim 1, wherein said catalyst is a solid.

6. The composition according to claim 5, wherein a characteristic dimension of said solid is at least about two nanometers.

7. A method for preparing fibrous catalyst-immobilization systems comprising the steps of:

providing a solution comprising both a fiber-forming material and a catalyst; and processing said solution into at least one fiber, wherein said catalyst is encapsulated within said fiber and said fiber comprises a polymeric fiber-forming material.

8. The method of claim 7, wherein said catalyst is insoluble in said solution.

9. The method of claim 8, wherein said catalyst has a characteristic dimension of at least about two nanometers.

10. The method of claim 7, wherein said solution comprises at least two distinct polymeric fiber-forming materials.

11. The method of claim 7, wherein said processing comprises electrospinning.

* * * * *